US007614815B1

(12) United States Patent
Huang

(10) Patent No.: US 7,614,815 B1
(45) Date of Patent: Nov. 10, 2009

(54) RECEIVING BAG HELD BY A HOOK-TYPE FOLDER

(76) Inventor: Si Chien Huang, 18F., No. 71, Sec. 2, Dunhua S. Rd., Taipei 106 (TW)

( * ) Notice: Subject to any disclaimer, the term of this patent is extended or adjusted under 35 U.S.C. 154(b) by 0 days.

(21) Appl. No.: 12/148,184

(22) Filed: Apr. 18, 2008

(51) Int. Cl.
*B42F 13/00* (2006.01)

(52) U.S. Cl. ..... 402/79; 402/80 P; 281/46

(58) Field of Classification Search ..... 206/472, 206/473, 308.1; 229/67.1, 67.4; 402/80 P, 402/80 R, 79, 73, 75, 501; 281/15.1, 31, 281/3.1, 2, 5, 46, 47, 44–45, 48–50; 40/771, 40/775, 776
See application file for complete search history.

(56) References Cited

U.S. PATENT DOCUMENTS 1,559,971 A * 11/1925 Meyer ..... 281/46
2,960,090 A * 11/1960 Shugart ..... 281/47
3,141,213 A * 7/1964 Rinaldi ..... 281/46
3,142,437 A * 7/1964 Grant et al. ..... 229/67.1
3,374,794 A * 3/1968 Reed ..... 206/225
3,469,333 A * 9/1969 Robert ..... 40/535
4,074,450 A * 2/1978 Schweinsberg ..... 40/403
4,444,418 A * 4/1984 Goldstein ..... 281/45
4,659,109 A * 4/1987 Donovan ..... 281/46
5,335,027 A * 8/1994 Lin et al. ..... 353/120
5,374,975 A * 12/1994 Amat ..... 355/75
6,012,866 A * 1/2000 Podosek ..... 402/79
6,168,340 B1 * 1/2001 Lehmann et al. ..... 402/79
6,485,060 B2 * 11/2002 Nada et al. ..... 281/45
6,942,414 B2 * 9/2005 Wong et al. ..... 402/79

FOREIGN PATENT DOCUMENTS

CH 661008 A * 6/1987

* cited by examiner

*Primary Examiner*—Dana Ross
*Assistant Examiner*—Jamila Williams
(74) *Attorney, Agent, or Firm*—Rosenberg, Klein & Lee

(57) ABSTRACT

A receiving bag held by a hook-type folder comprises a bag, an opening and at least one notch. The bag has a receiving space. The opening is positioned at an upper side of the bag and communicating with the receiving space. At least one notch is positioned at an inner side of the bag and communicating with the receiving space. When the bag is held by the folder, the upper side of the bag and an under side of the bag are positioned outside folder's hooks. The lengths of the bag aren't restricted by the hooks.

7 Claims, 10 Drawing Sheets

RECEIVING BAG HELD BY A HOOK-TYPE FOLDER

BACKGROUND OF THE INVENTION

1. Field of the Invention

The present invention is related to a receiving bag held by a hook-type folder, especially a receiving bag having at least one notch.

2. Description of Related Art

Many people often use a folder to receive and classify documents, newspapers or magazines. Please refer to FIG. 1, illustrating a hook-type folder 10. The hook-type folder 10 comprises a main board 11, and right and left sides of the main board 11 are respectively connected with a side board 12. The two side boards 12 can pivot around the main board 11. Two fixing devices 13 are respectively fixed at two ends of the main board 11. A plurality of hooks 14 are mounted on every fixing device 13. The hook 14 has a base portion 141 which is positioned at the fixing device 13. A connecting portion 142 is extended from an upper end of the hook 14 forwardly. A hook portion 143 extends from an end of the connecting portion 142 toward an inner of the main board 11. A clearance is formed between the hook portion 143 and the fixing device 13.

Please refer to FIG. 2. User can open a magazine 15, and then put pages of the magazine 15 on the clearance between the hook portion 143 and the fixing device 13. The magazine 15 is clipped by the hook portion 143 and the fixing device 13. The magazine 15 doesn't drop from the main board 11. The magazine 15 can be hooked on the main board 11 of the hook-type folder 10.

Please refer to FIG. 3 and FIG. 3A. People can use the hook-type folder 10 to receive documents or papers. Firstly a user can put documents or papers into a receiving bag 16. The receiving bag 16 is oblong. An upper side of the receiving bag 16 has an opening 161 and a under side of the receiving bag 16 has another opening 162 near a corner of the receiving bag 16. And then users respectively can put the two sides of the receiving bag 16 into the two clearances between the hook portions 143 and the fixing devices 13 via the two openings 161, 162. The hook portions 143 enter into the inner of the receiving bag 16 and the receiving bag 16 can be hooked onto the main board 11. The receiving bag 16 doesn't drop from the main board 11.

However, the lengths of the two sides of the receiving bag 16 must be smaller than the distance between the two connecting portions 142 of the two hooks 14, otherwise the two sides of the receiving bag 16 will lean the connecting portions 142, The connecting portions 142 deform the receiving bag 16, so the lengths of the two sides of the receiving bag 16 can't be the same as the lengths of the two sides of the folder 10.

The inventor of the present invention recognizes that the above shortage should be corrected and a special effort has been paid to research this field. The present invention is presented with reasonable design and good effect to resolve the above problems.

SUMMARY OF THE INVENTION

The object of the present invention is to provide a receiving bag of a folder, and the lengths of the two sides of the receiving bag can be the approximately same as the dimensions of the two sides of the folder.

For achieving the object described above, the present invention provides a receiving bag held by a hook-type folder. The receiving bag comprise a bag, a opening and at least one notch. The bag has a receiving space. The opening is positioned at an upper side of the bag and communicating with the receiving space. The notch is positioned at an inner side of the bag and communicating with the receiving space.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The above and further advantages of this invention may be better understood by referring to the following description, taken in conjunction with the accompanying drawings, in which.

The drawings will be described further in connection with the following detailed description of the present invention.

DETAILED DESCRIPTION OF THE PREFERRED EMBODIMENTS

Figure 1:
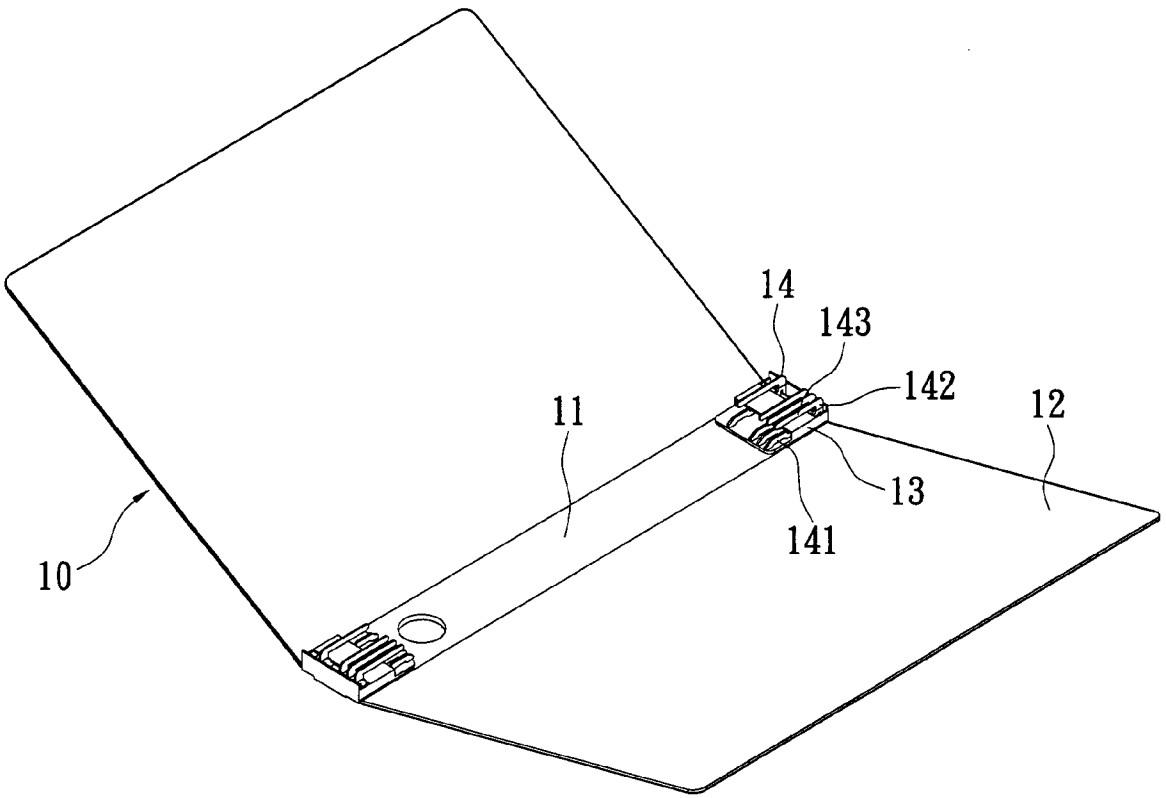
FIG. 1 PRIOR ART
FIG. 1 is a perspective view of the related hook-type folder.
Figure 2:
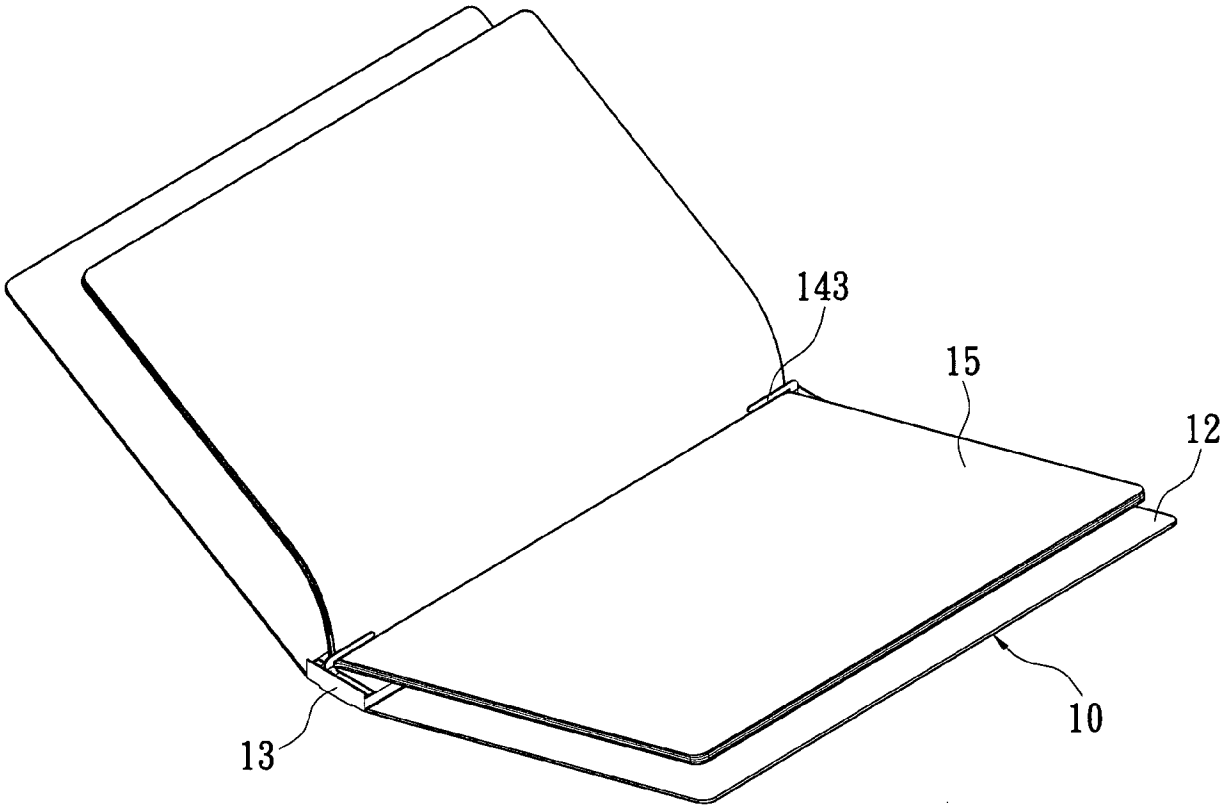
FIG. 2 PRIOR ART
FIG. 2 is a schematic view of the related hook-type folder which hooks the magazine.
Figure 3:
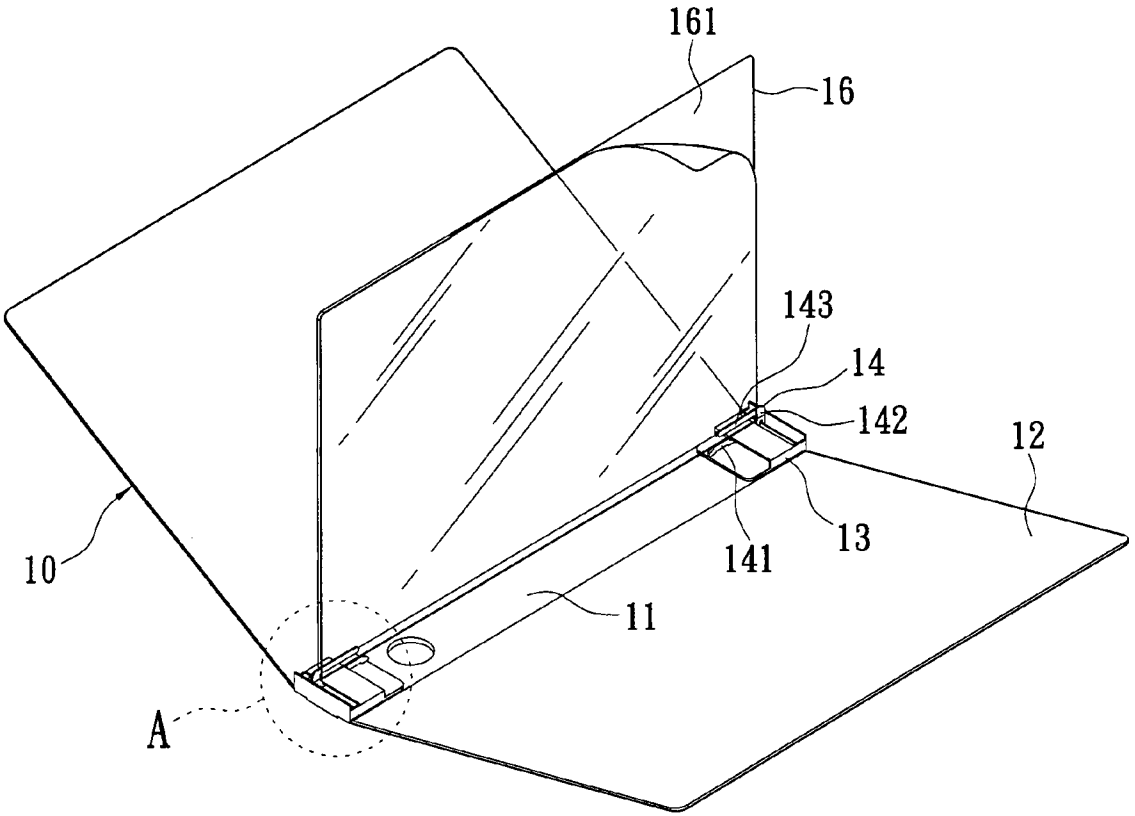
FIG. 3 PRIOR ART
FIG. 3 is a schematic view of the related hook-type folder which receives the receiving bag.
Figure 3A:
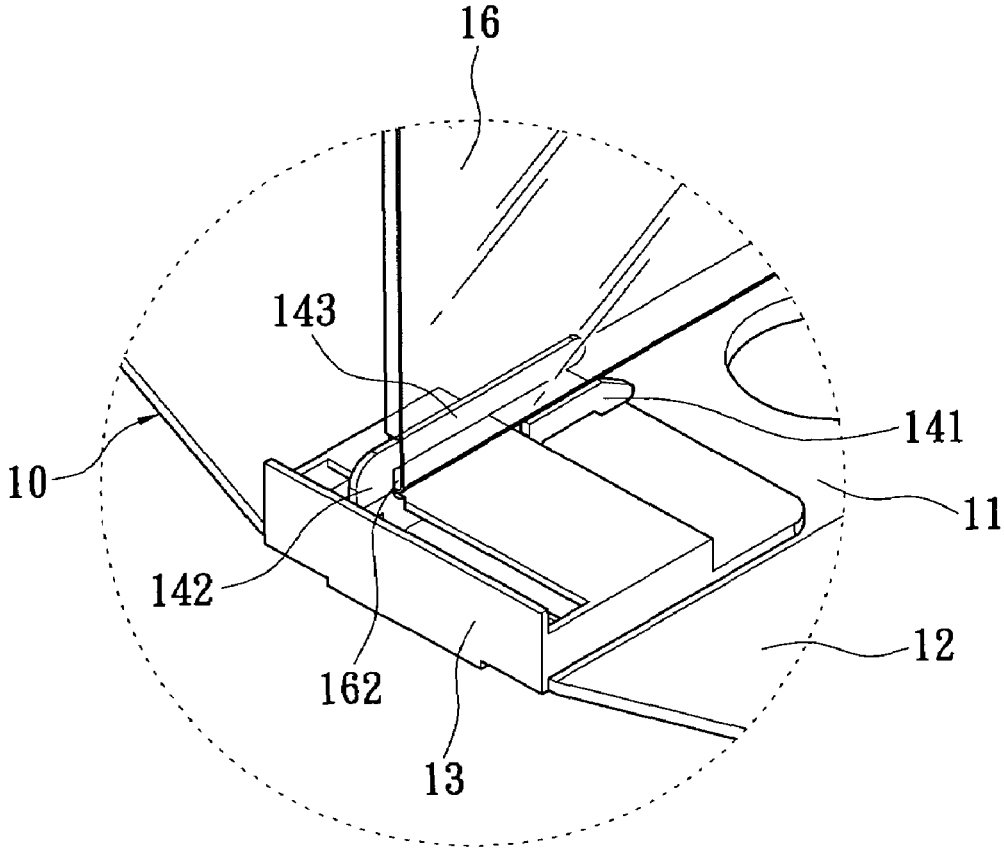
FIG. 3A PRIOR ART
FIG. 3A is a partial enlarged view of FIG. 3.
Figure 4:
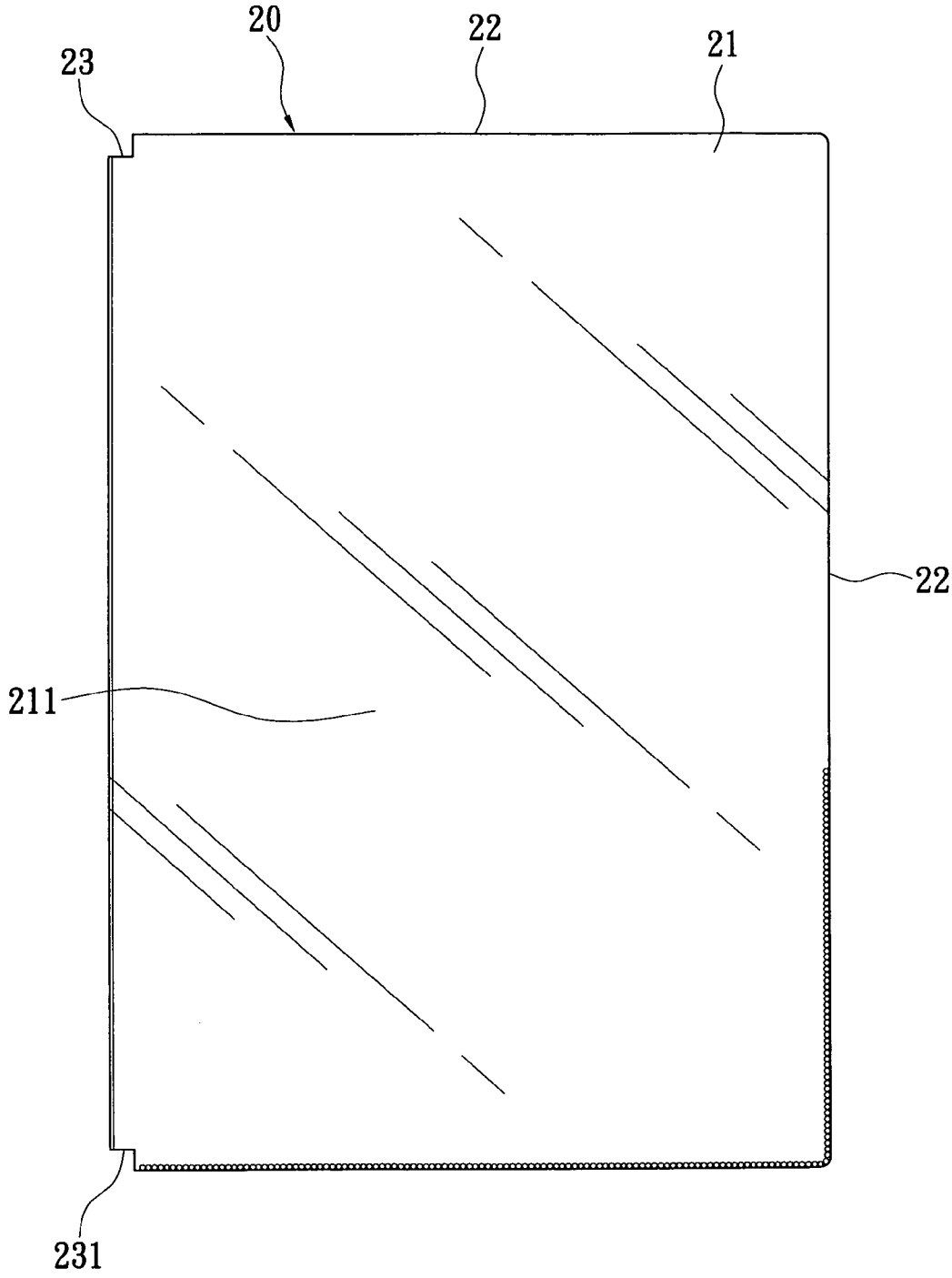
FIG. 4 is a horizontal view of the receiving bag of the folder of the present invention.
Figure 5:
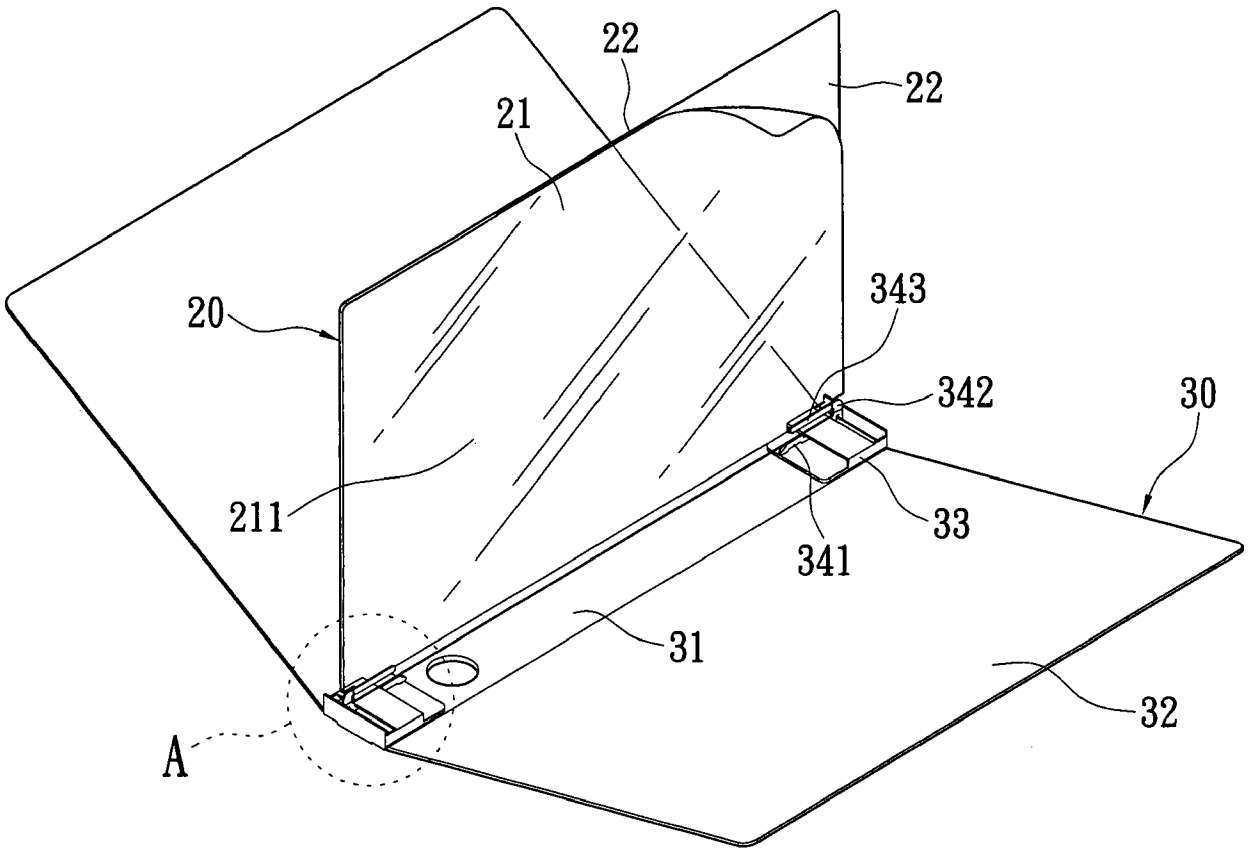
FIG. 5 is a perspective view about using the receiving bag of the folder of the present invention.
Figure 5A:
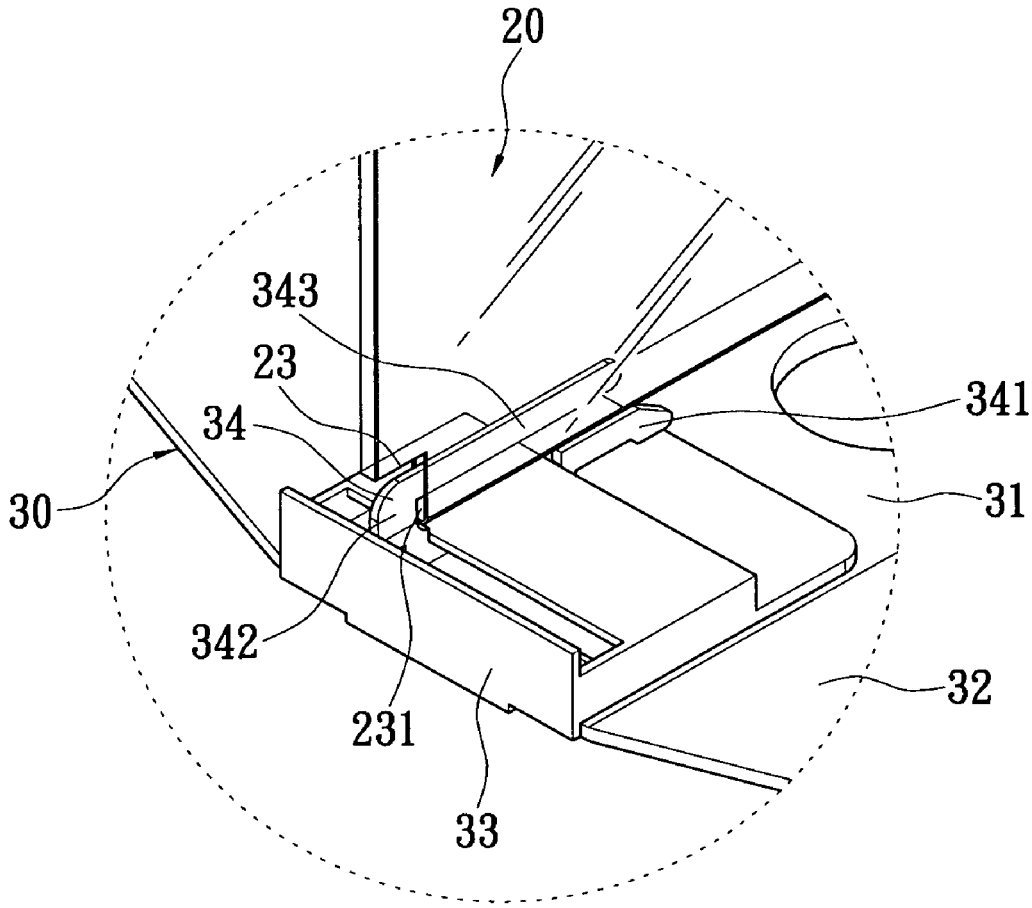
FIG. 5A is a partial enlarged view of FIG. 5.

The above and further advantages of this invention may be better understood by referring to the following description, taken in conjunction with the accompanying drawings, in which:

Please refer to FIG. 4, FIG. 5 and FIG. 5A, illustrating a receiving bag of a folder 20 of a present invention. The receiving bag of the folder 20 is held by a hook-type folder 30. The receiving bag 20 comprises a bag 21, two first openings 22 and two notches 23.

The bag 21 is oblong approximately. The bag 21 has a receiving space 211. The two openings 22 are positioned at an upper side of the bag 21 and a outer side of the bag 21 respectively. The two first openings 22 are communicating with the receiving space 211. Hereby user can put documents or papers into the bag 21. The two notches 23 respectively are positioned at two ends of an inner side of the bag 21. The two notches 23 are communicating with the two first openings 22 respectively, and the two notches 23 form a second opening 231 on the bag 21 respectively. The two second openings 231 are communicating with the receiving space 211.

The hook-type folder 30 includes a main board 31. A right side of the main board 31 and a left side of the main board 31 are connected with a side board 32 respectively. The two side boards 32 can pivot around the main board 11. The two side boards 32 are bracing of the hook-type folder 30. Even if the main board 31 hooks many documents and papers, the main board 31 isn't deformed by the documents and the papers.

An upper end of the main board 31 and a under end of the main board 31 fix a fixing device 33 respectively, and a plurality of hooks 34 is mounted on every fixing device 33 respectively. Every hook 34 has a base portion 341 which is mounted on the fixing device 33. An upper edge of the base portion 341 extends a connecting portion 342 forwardly, and an end of the connecting portion 342 extends a hook portion 343 inwardly. The hook portion 343 is outside the fixing device 33, and a clearance is formed between the hook portion 343 and the fixing device 33.

Figure 6:
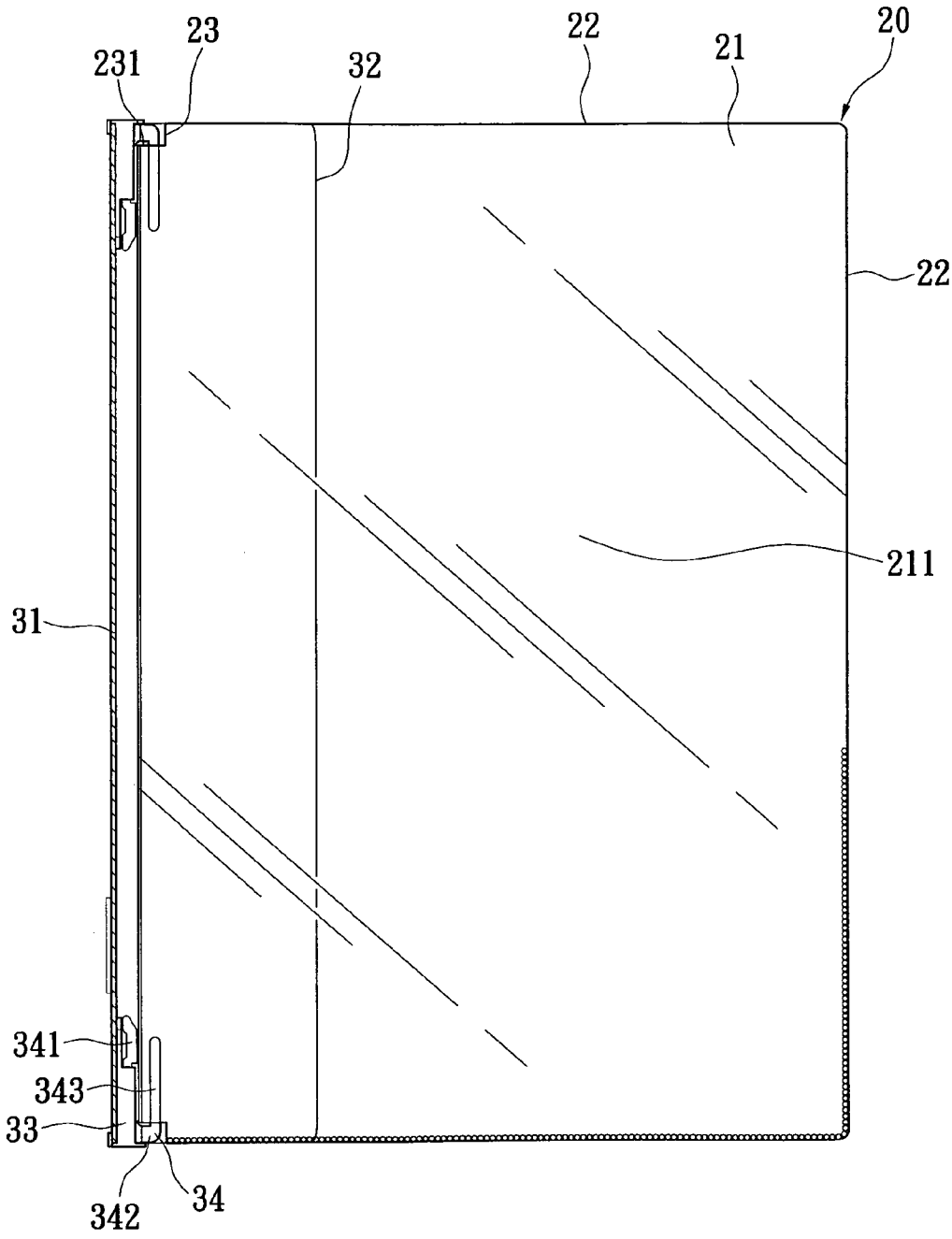
FIG. 6 is a horizontal view about using the receiving bag of the folder of the present invention.

Please refer to FIG. 6. Users enter the two hook portions 343 into the receiving space 211 via the two notches 23 respectively and the receiving bag 20 is hooked onto the main board 31, and doesn't drop from the main board 31. When the hook portions 343 enters into the receiving space 211, the upper side of the bag 21 and the under side of the bag 21 are outside the connecting portions 342 and the hook portions 343 respectively. The dimension of the upper side of the bag 21 and the dimension of the under side of the bag 21 aren't restricted by the positions of the connecting portions 342 respectively, so the length of the receiving bag 20 can be longer than the distance between the two connecting portions 342. The length of the receiving bag 20 can be designed to be the same as the length of the main board 31 of the hook-type folder 30.

Figure 7:
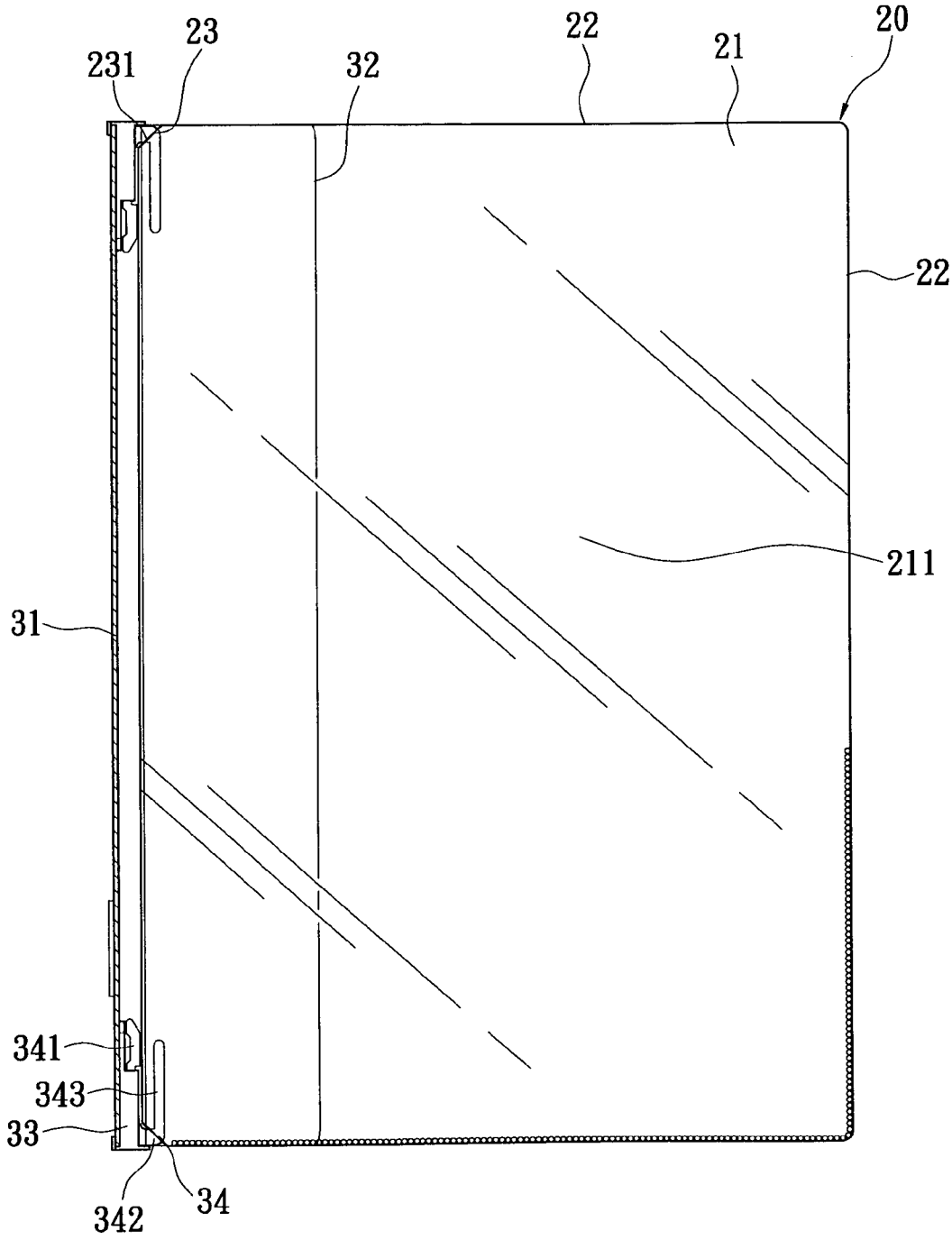
FIG. 7 is a horizontal view about using the receiving bag of the folder according to a second embodiment of the present invention.

Please refer to FIG. 7, illustrating a second embodiment according to the present invention. The difference between the first embodiment and the second embodiment is that the notches 23 are triangular.

Figure 8:
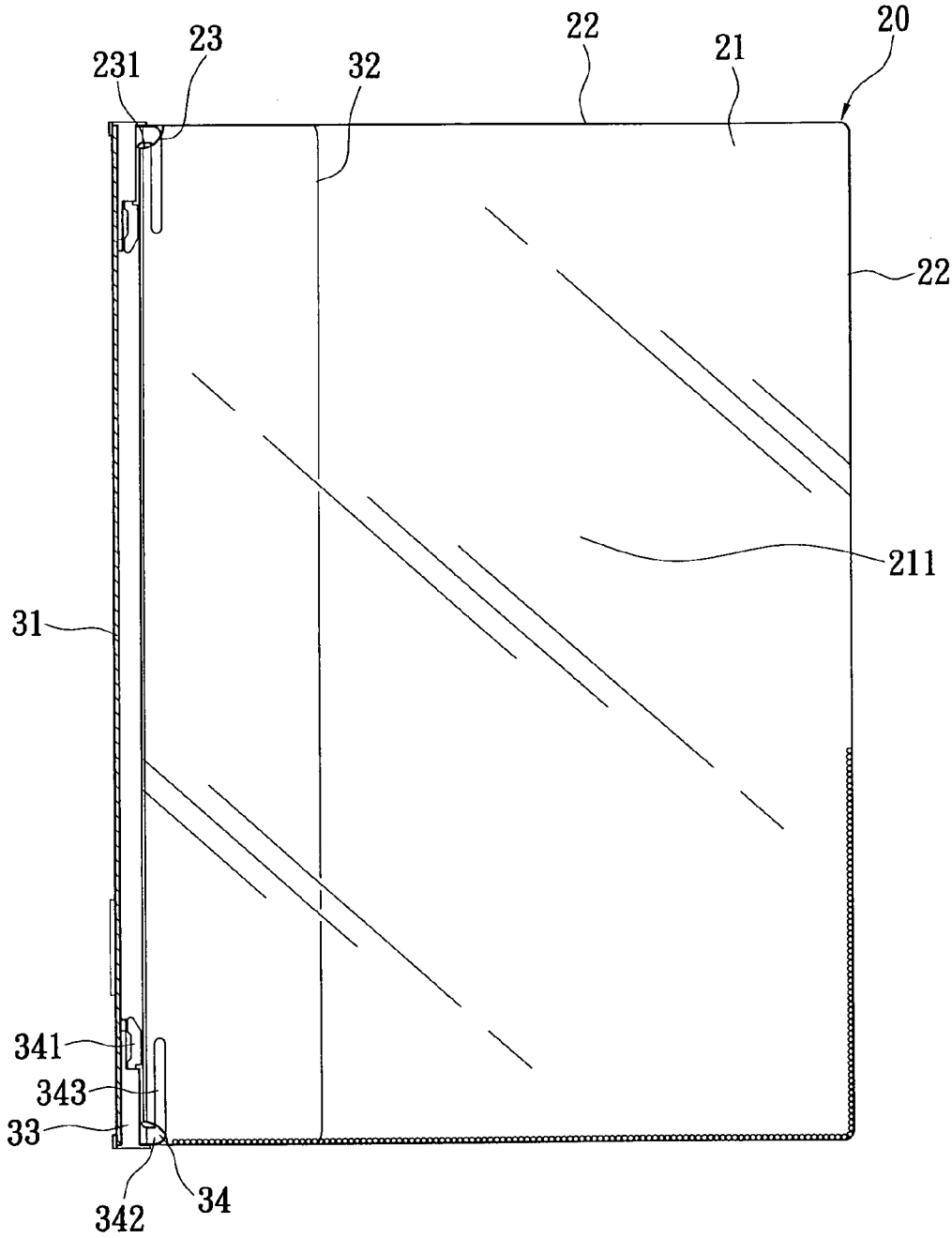
FIG. 8 is a horizontal view about using the receiving bag of the folder according to a third embodiment of the present invention.

Please refer to FIG. 8, illustrating a third embodiment according to the present invention. The difference between the first embodiment, the second embodiment and the third embodiment is that the notches 23 are fan-shaped notches.

Hence, the receiving bag held by the hook-type folder of the present invention has the following features:

1. The hook portions 343 can enter into the receiving space 211 via the notches 23 respectively and the bag 21 is held by the hook-type folder 30. The upper side of the bag 21 and the under side of the bag 21 are outside the hooks 34 respectively, so the upper side of the bag 21 and the under side of the bag 21 will not lean the hooks 34 respectively. The length of the upper side of the bag 21 and the length of the under side of the bag 21 aren't restricted by the positions of the hooks 34 respectively, so the length of the bag 21 can be designed to be the same as the length of the hook-type folder 30 approximately.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A receiving bag held by a hook-type folder having a pair of hook portions at two ends thereof in a longitudinal direction, comprising:

a bag body having a receiving space, the bag body having an opened upper side and at least two closed sides adjacent to one another;

a first opening positioned at the upper side for being in communication with the receiving space; and two notch portions respectively positioned at two ends of one of the two closed sides of the bag body in a longitudinal direction;

wherein the two notch portions each have a second opening for being in communication with the receiving space, and the hook portion of the hook-type folder is received in the receiving space through the second opening of the notch portion, so that the length of the bag body in the longitudinal direction is capable of being substantially same to the length of the hook-type folder.

2. The receiving bag as claimed in claim 1, wherein the notch portion is oblong.

3. The receiving bag as claimed in claim 1, wherein the notch portion is triangular.

4. The receiving bag as claimed in claim 1, wherein the notch portion is fan-shaped.

5. The receiving bag as claimed in claim 1, wherein the bag body has an another opened side, the another opened side has an another first opening.

6. The receiving bag as claimed in claim 5, wherein the first opening and the another first opening are communicating with each other.

7. The receiving bag as claimed in claim 6, wherein the two second openings are communicating with each other.

* * * * *